US010081093B2

(12) United States Patent
Hile

(10) Patent No.: US 10,081,093 B2
(45) Date of Patent: Sep. 25, 2018

(54) DRIVE MECHANISM FOR JAW ACTUATED DEVICE

(71) Applicant: Jeffrey B. Hile, Wexford, PA (US)

(72) Inventor: Jeffrey B. Hile, Wexford, PA (US)

( * ) Notice: Subject to any disclaimer, the term of this patent is extended or adjusted under 35 U.S.C. 154(b) by 284 days.

(21) Appl. No.: 15/241,204

(22) Filed: Aug. 19, 2016

(65) Prior Publication Data

US 2016/0368118 A1 Dec. 22, 2016

Related U.S. Application Data

(63) Continuation-in-part of application No. 14/037,661, filed on Sep. 26, 2013, now Pat. No. 9,463,555.

(51) Int. Cl.

| | |
|---|---|
| ***B25B 7/12*** | (2006.01) |
| ***B25B 1/02*** | (2006.01) |
| ***B25B 5/02*** | (2006.01) |
| ***B25B 5/06*** | (2006.01) |
| ***B25B 7/16*** | (2006.01) |
| ***B25B 1/04*** | (2006.01) |
| ***B25B 9/00*** | (2006.01) |
| ***B25B 5/12*** | (2006.01) |
| ***B25B 5/04*** | (2006.01) |
| ***B25B 7/08*** | (2006.01) |
| ***B25B 7/14*** | (2006.01) |

(52) U.S. Cl.

CPC ..... *B25B 7/12* (2013.01); *B25B 1/04* (2013.01); *B25B 5/04* (2013.01); *B25B 5/06* (2013.01); *B25B 5/12* (2013.01); *B25B 7/08* (2013.01); *B25B 7/123* (2013.01); *B25B 7/14* (2013.01); *B25B 7/16* (2013.01); *B25B 9/00* (2013.01)

(58) Field of Classification Search

CPC .. B25B 5/06; B25B 5/12; B25B 5/166; B25B 7/12; B25B 7/123; B25B 7/16; B25B 9/00; B25B 1/04; B25B 7/08; B25B 1/06; B25J 15/0266; B25J 15/0273

USPC ..... 81/348, 351, 370, 341; 269/6, 166–170, 269/218; 294/115

See application file for complete search history.

(56) References Cited

U.S. PATENT DOCUMENTS 1,162,059 A * 11/1915 Hersey ..... B25B 5/068 269/157
2,916,323 A * 12/1959 Berkum ..... B25B 7/00 294/115
4,863,204 A * 9/1989 Peters ..... B25J 1/04 294/115

* cited by examiner

*Primary Examiner* — Bryan R Muller
(74) *Attorney, Agent, or Firm* — Carothers and Carothers

(57) ABSTRACT

A linear ratchet drive mechanism operable single handedly for pivotally actuating one or more plier jaws in a diverging or converging direction for gripping objects under extreme pressure. A drive rod is received in a handle body for axial movement with one end of the drive rod pivotally linked to the jaw or jaws in order to actuate the jaws. An actuating lever is pivotally connected at one end to the handle body and extends from the handle body for single hand actuation by squeezing the lever against spring biased towards the handle body. The actuating lever is provided with a leverage arm that extends from the pivoting end of the actuating lever and is pivotally connected to a drive grip lever having an aperture surrounding the drive rod for binding against the drive rod for thereby driving the drive rod in one direction when the drive grip lever is canted and moved by squeezing the actuating lever. An incremental stop mechanism is also provided to quickly retain the jaw spacing after initial use of the device.

3 Claims, 8 Drawing Sheets

DRIVE MECHANISM FOR JAW ACTUATED DEVICE

CROSS REFERENCE

The present application is a continuation-in-part of U.S. patent application Ser. No. 14/037,661, filed on Sep. 26, 2013, for DRIVE MECHANISM FOR JAW ACTUATED CLAMPING DEVICE.

BACKGROUND OF THE INVENTION

The present invention relates to hand tools and more particular to a clamp having a setting mechanism that permits the jaws of the clamp to be engaged with a work piece with a drive mechanism operable with one hand. The jaws of the clamping mechanism may be configured to either diverge or converge in order to clamp.

It is a principal object of the present invention to provide pliers with either pivotally diverging or converging jaws which can be operated with a single hand drive mechanism in a step-by-step linear ratchet manner, and yet provide clamping capabilities having a jaw pressure in excess of 1,800 pounds.

SUMMARY OF THE INVENTION

The present invention provides a drive for pivotally actuating at least one jaw of a pair which is pivotally coupled to a handle body. A drive rod is received in the handle body for axial movement with one end of the rod pivotally linked to the at least one jaw for pivoting the jaw with axial movement of the rod. An actuating lever is pivotally connected at one end to the handle body and extends therefrom for single hand actuation by squeezing, or sequentially squeezing, the lever against spring bias towards the handle body. This actuating lever is provided with a leverage arm extending from the pivoted end of the actuating lever and extending towards the drive rod.

The drive mechanism includes a drive grip lever that has an aperture surrounding the rod for binding against the drive rod and thereby slidably moving the drive rod in the aforesaid one direction when the drive grip lever is canted and moved. A distal end of this leverage arm is pivotally coupled to the drive grip lever whereby the drive grip lever will cant and thereby bind the aperture of the drive grip lever on the drive rod when the actuating lever is pivoted to thereby axially drive and move the drive rod in the one direction to correspondingly pivot one or more clamping jaws.

The spring bias for the actuating lever may be provided by a spring biasing the drive grip lever against movement of the drive rod in the aforesaid one or jaw driving direction. A release spring biases the drive rod to move in a direction opposite to the aforesaid one direction or drive direction, and a release lever is positioned for pivotal movement in the handle body. The release lever has a position-holding grip aperture surrounding the drive rod and the release lever is biased whereby this grip aperture cants and thereby binds against the drive rod to normally prevent movement of the drive rod in the direction opposite to the jaw driving direction. The release lever is displaceable against its bias to uncant the position-holding grip aperture whereby the drive rod is released by the position-holding grip aperture to thereby prevent free movement of the drive rod under spring bias in the aforesaid opposite direction.

The pivotal jaw or jaws being driven may be configured and pivotally coupled to the drive rod for actuation in either a diverging or a converging manner of operation. For example, a pair of such pivoting jaws may be provided, positioned and configured on the handle body to function as plier jaws.

An incremental stop mechanism for prepositioning or retaining the spacing of the jaws after actuation and release of the drive is provided and includes an elongate slot in the handle body which is aligned with the drive rod for the drive mechanism. The elongate slot is provided with a rack along one side edge thereof and an exposed spring biased depression button is received in the slot for sliding therealong. The button has an inwardly protruding shaft extending through the slot and the distal end of the protruding shaft is provided with one or more radially extending cogs for engaging the rack when the button is disengaged under spring bias. The button shaft is dimensioned for engaging the drive mechanism and incrementally retaining the jaws from fully opening. The button is depressed under spring bias to release the cog or cogs from the rack and slid in the slot to engage the drive mechanism with the button shaft in order to incrementally retain the jaws from fully opening upon release of said drive mechanism after use to release the clamping jaws from a work piece. This provides quick incremental prepositioning of the jaws prior to the next use, thereby eliminating the need to repeatedly squeeze the actuating lever numerous times for providing the initial incremental spacing of the jaws prior to the next engagement.

In one embodiment, the button shaft may be dimensioned to engage the pivotal coupling of the jaws to the adjacent end of the drive rod for thereby stopping the full movement of the drive rod away from the jaws upon actuation of the release mechanism.

BRIEF DESCRIPTION OF THE DRAWINGS

Other objects and advantages appear hereinafter in the following description and claims. The appended drawings illustrate certain practical embodiments of the present invention, without limiting the scope of the invention or the appended claims, wherein:

DETAILED DESCRIPTION OF A PREFERRED EMBODIMENT

Figure 1:
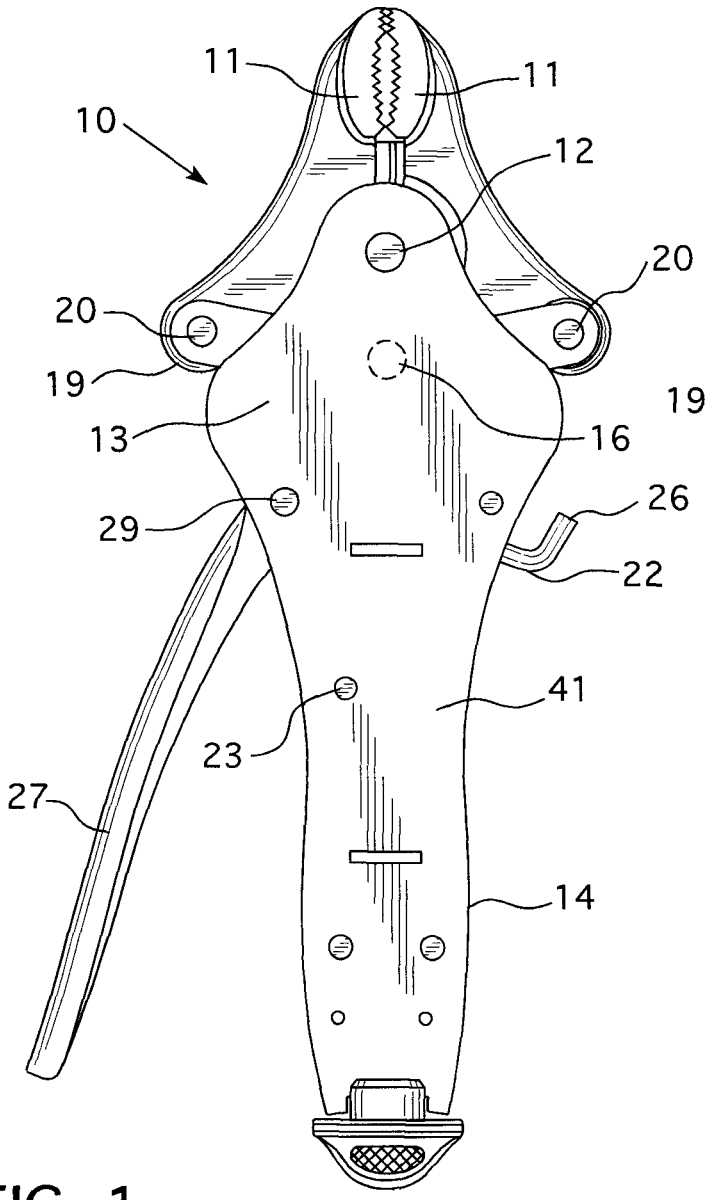
FIG. 1 is a view in front elevation showing one embodiment of the present invention illustrated in the form of pliers operable with a single hand linear ratchet drive mechanism which functions in a step-by-step manner.
Figure 4:
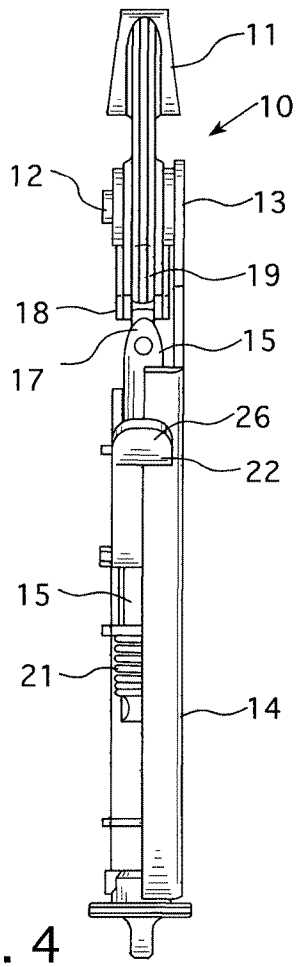
FIG. 4 is a view in right side elevation of the pliers illustrated in FIG. 2.
Figure 2:
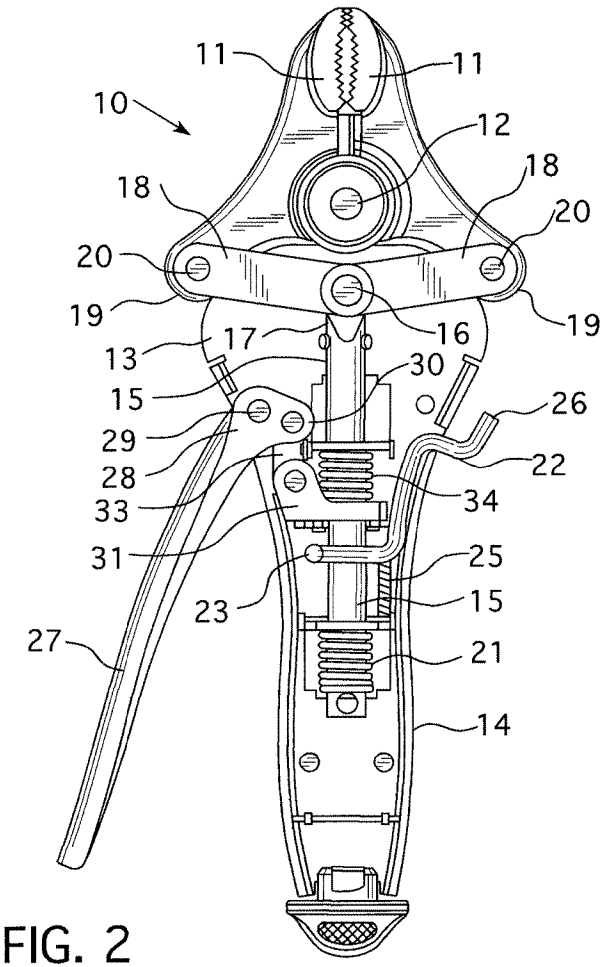
FIG. 2 is a view in front elevation of the pliers shown in FIG. 1 with the front cover thereof removed to illustrate the operation internal drive mechanism.
Figure 3:
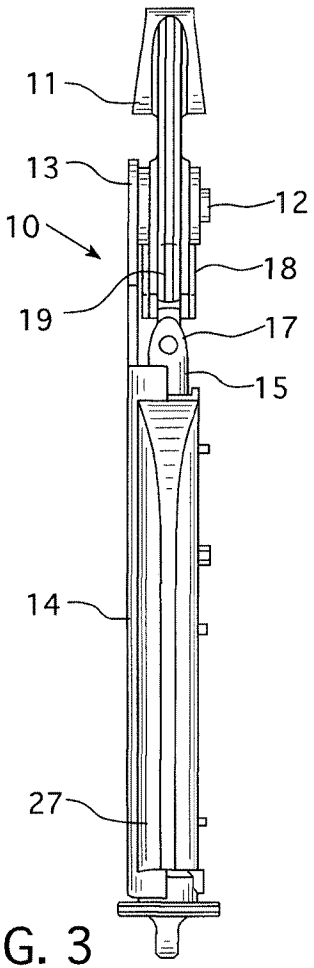
FIG. 3 is a view in left side elevation of the pliers shown in FIG. 2.
Figure 6:
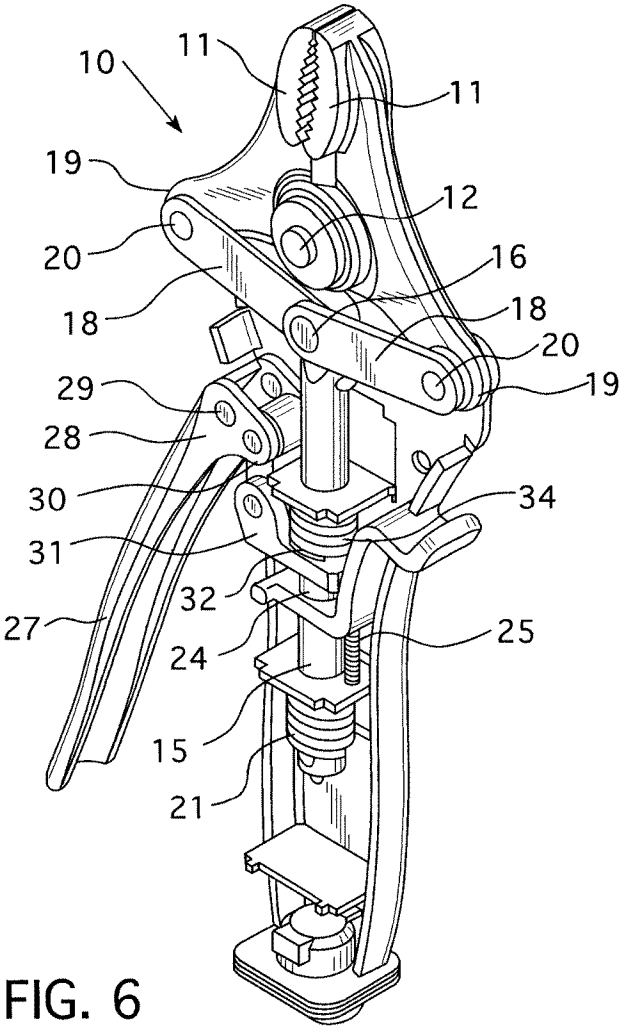
FIG. 6 is a right side perspective view of the pliers shown in FIG. 2.
Figure 5:
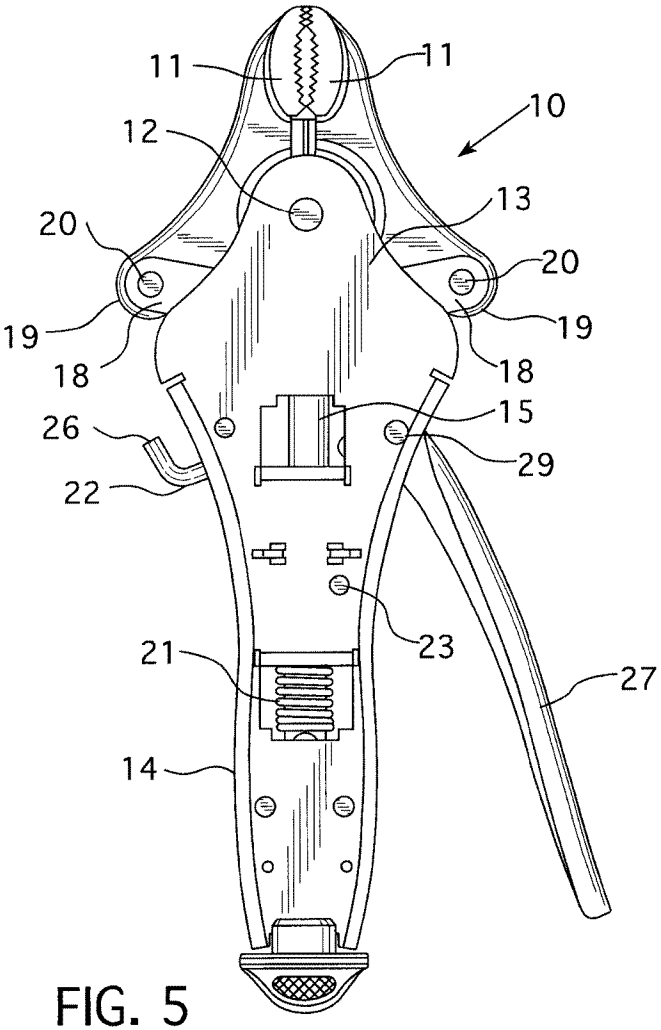
FIG. 5 is a view in rear elevation of the pliers shown in FIG. 2.

Referring to FIGS. 1-6, the pliers 10 illustrated in the drawing figures are provided with a pair of plier jaws 11 pivotally coupled at pivot 12 to end 13 of elongate handle body 14. Drive rod 15 is received in handle body 14 for axial movement relative to handle body 14 in the direction of elongation of handle body 14.

Jaws 11 are pivotally coupled at pivot 16 to adjacent end 17 of drive rod 15 with respective drive links 18 which are configured for closing jaws 11 when drive rod 15 is axially moved toward the jaws 11. In order to provide plier clamping jaws 11 with adequate jaw pressure, the plier jaws 11 are respectively provided with laterally and outwardly extending leverage protrusions 19, to which the drive links 18 are pivotally connected at pivots 20.

Drive rod 15 is engaged with spring 21 which biases rod 15 to axially move in a direction away from jaws 11 for thereby normally urging jaws 11 open. A release lever 22 is positioned in handle body 14 for pivotal movement at its distal end about pivot 23. Release lever 22 is provided with a position-holding grip aperture 24 which surrounds drive rod 15. Release lever 22 is positioned in handle body 14 under spring bias of spring 25 whereby position-holding grip aperture 24 is axially canted relative to the axis of drive rod 15 for thereby causing the position-holding grip aperture 24 to normally bind and grip onto drive rod 15 and thereby prevent movement of drive rod 15 away from jaws 11. Release lever 22 is configured to release the drive rod 15 under the bias of spring 21 when the outer end 26 of release lever 22 is depressed against the bias of bias spring 25.

Actuating lever 27 extends generally in parallel with handle body 14 and is pivotally connected at its end 28 to handle body 14 at pivot 29. Actuating lever 27 is provided with a leverage arm 30 laterally extending from end 28 of actuating lever 27 toward drive rod 15 with the distal end of leverage arm 30 spaced from leverage arm pivot 29.

A drive grip lever 31 is provided with aperture 32 surrounding drive rod 15. Drive grip lever 31 is moveable toward jaws 11 for canted binding engagement of its aperture 32 with drive rod 15 to move drive rod 15 in a direction toward the jaws 11. The distal end of leverage arm 30 is pivotally coupled to drive grip lever 31 via coupling link 33 for canting drive grip lever 31 and thereby binding its grip aperture 32 to move drive rod 15 toward jaws 11 in order to pivotally close jaws 11 to grip a work piece.

Compression spring 34 biases drive grip lever 31 to move in a direction away from jaws 11 for releasing the grip of drive aperture 32 of drive grip lever 31 on drive rod 15, whereby spring 34 biases actuating lever 27 outwardly for repeated actuation whereby repeated actuations of actuating lever 27 closes jaws 11 with a linear step-by-step ratchet action of drive rod 15 between drive grip lever 31 and release lever 22.

Provided the materials selected for assembling the pliers are sufficiently strong, jaw pressures in excess of 1,800 pounds may be obtained.

Figure 7B:
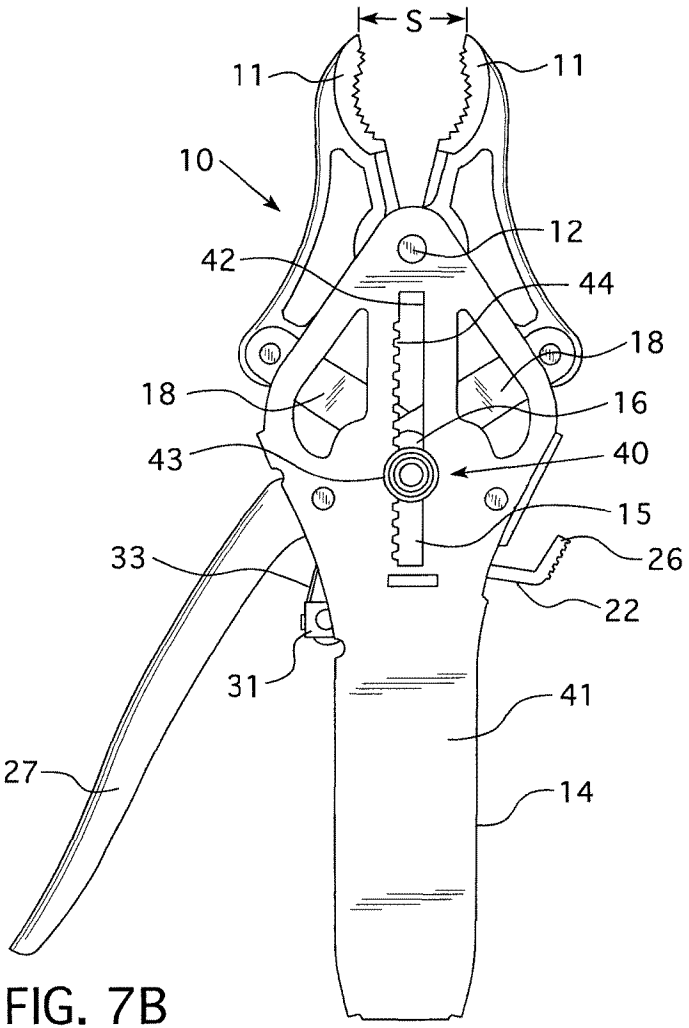
FIG. 7B illustrates the pliers of FIG. 7A with the incremental stop mechanism advanced from the zero position of FIG. 7A to an intermediate position illustrated in the figure showing the jaws being advanced by the incremental stop mechanism to a more closed position.
Figure 7A:
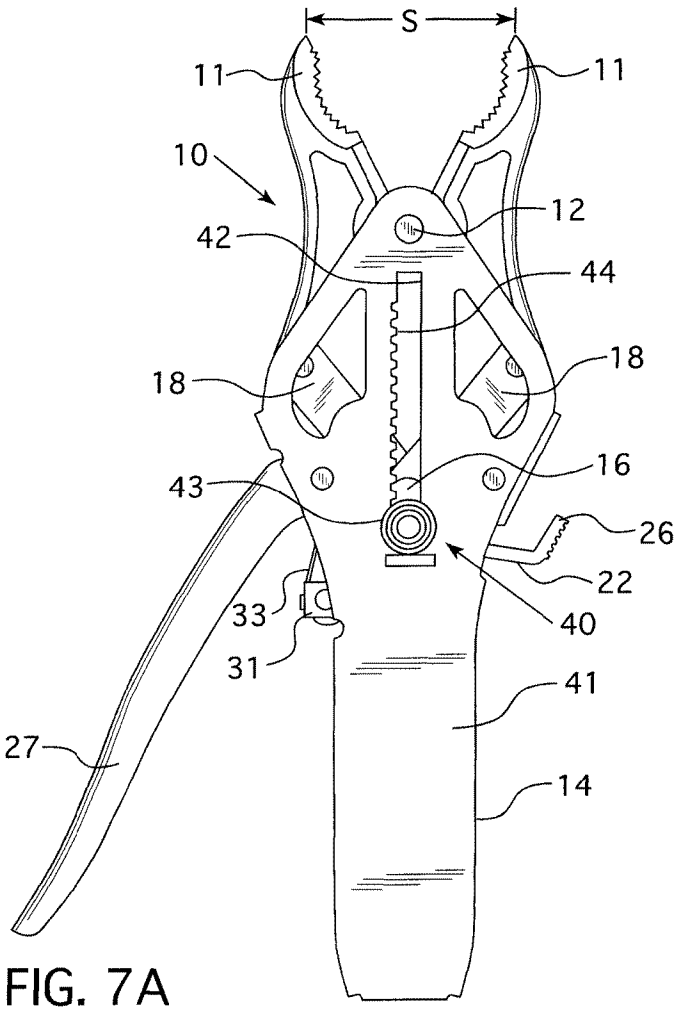
FIG. 7A is a view in front elevation showing the embodiment of FIG. 1 with modifications providing an incremental stop mechanism for prepositioning the spacing of the jaws prior to actuation of the drive illustrating the incremental stop mechanism as being in the zero position with the jaws spread to their maximum.
Figure 7C:
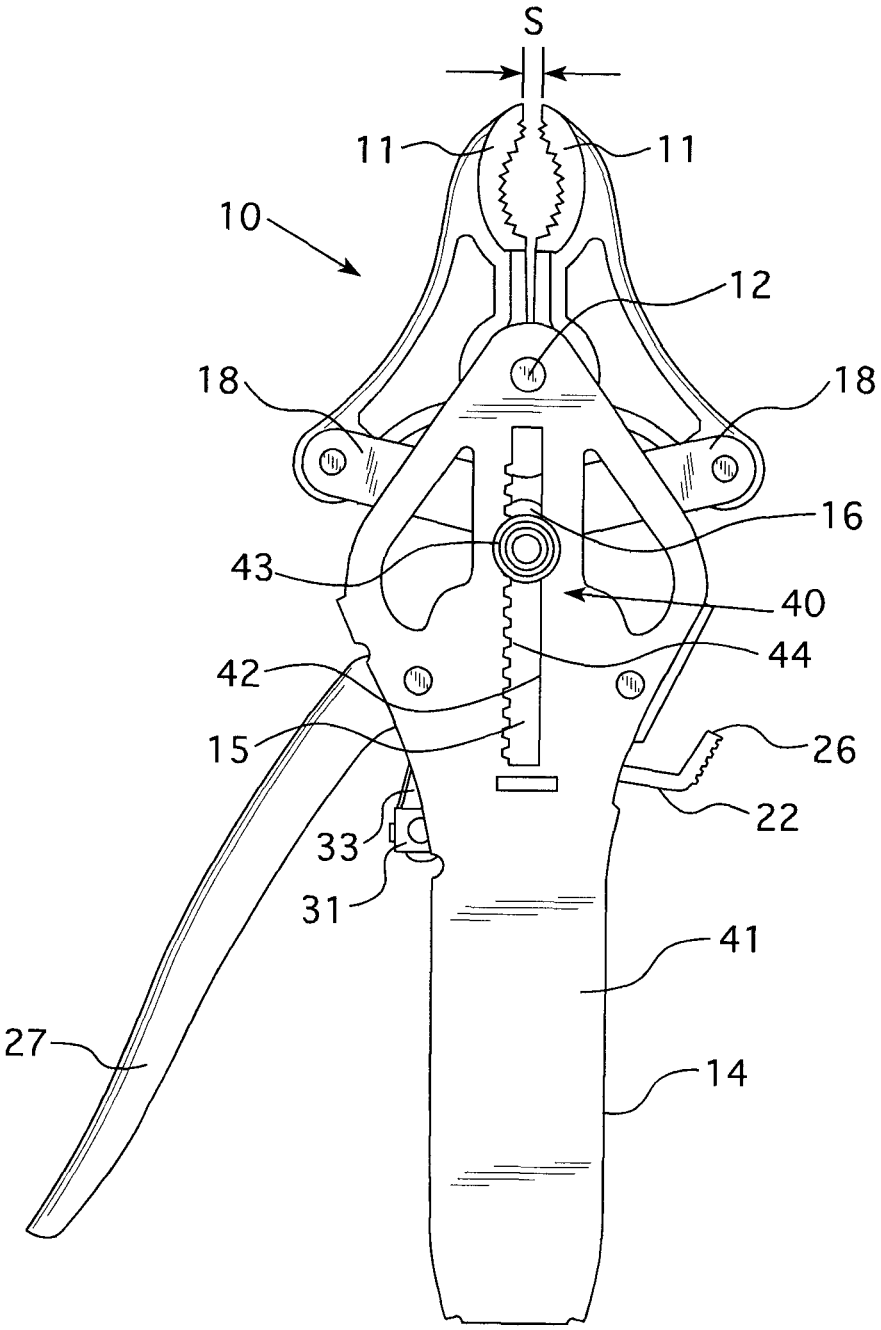
FIG. 7C illustrates the pliers of FIG. A advanced by the incremental stop mechanism for initial positioning of the plier jaws to an almost closed position.
Figure 8A:
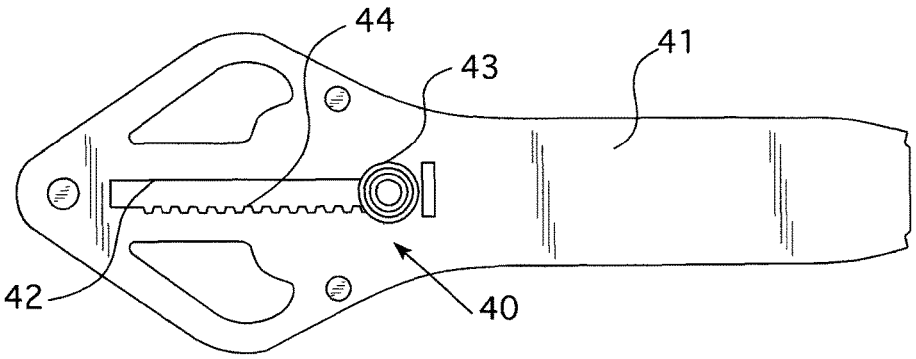
FIGS. 8A-8F are diagrammatic views illustrating the sequential steps for incrementally actuating the stop mechanism shown in FIGS. 7A-7C.
Figure 8B:
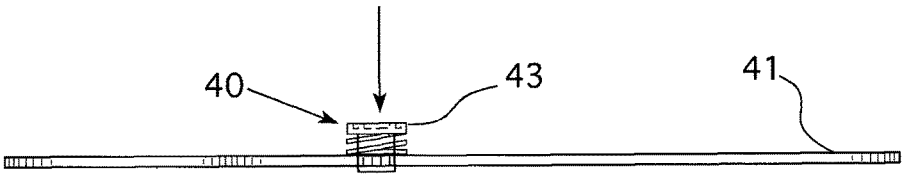
Figure 8C:
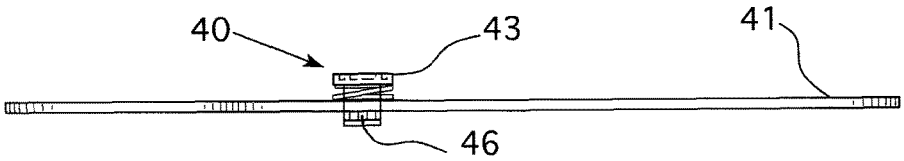
Figure 8D:
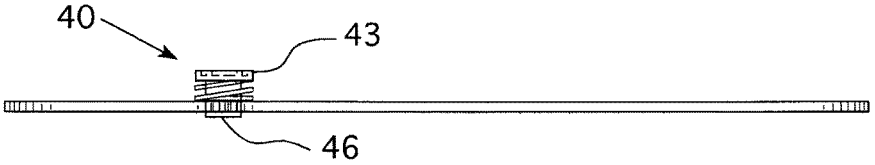
Figure 8E:
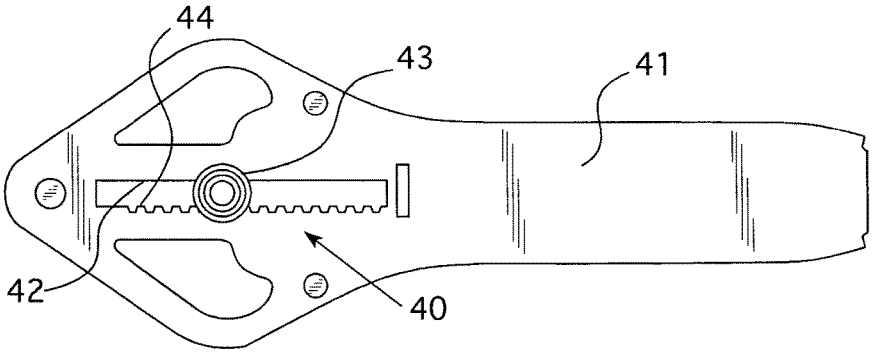
Figure 8F:
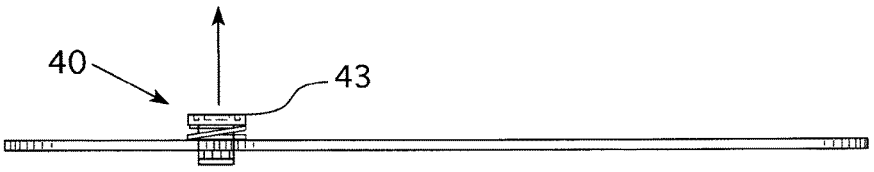
Figure 9A:
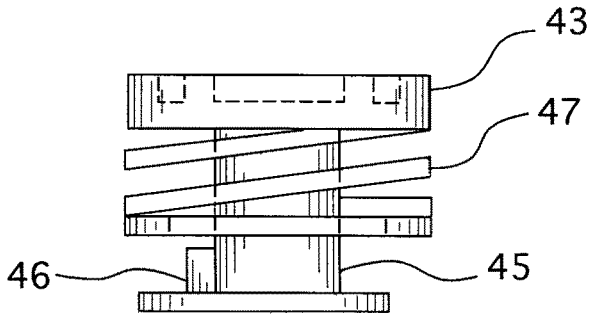
FIG. 9A is an enlarged schematic view of the spring biased depression button used to manipulate the incremental stop mechanism illustrated in FIGS. 7 and 8.
Figure 9B:
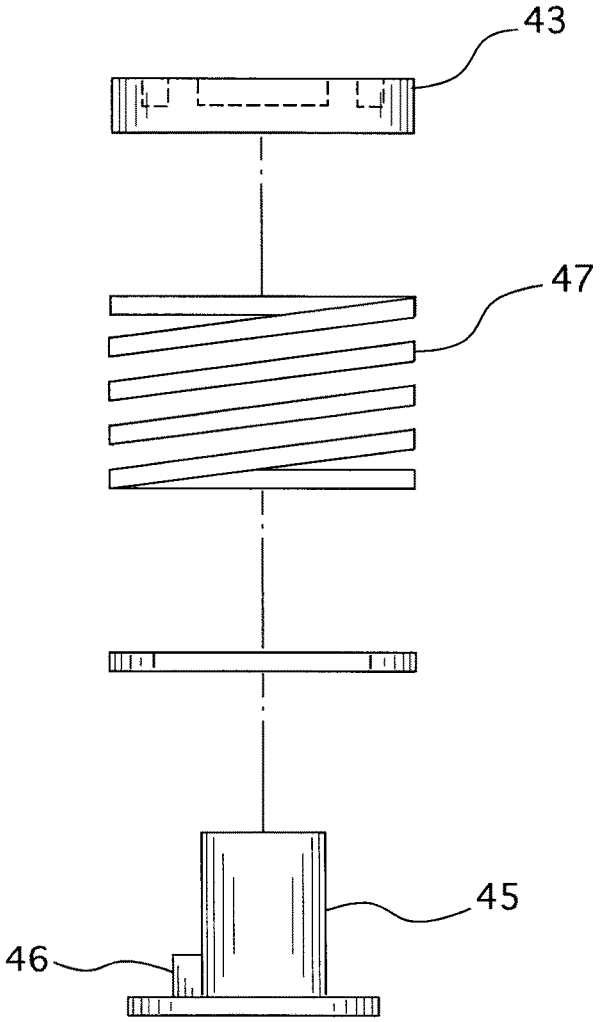
FIG. 9B is an exploded view of the button assembly shown in FIG. 9A.

Referring next, to the embodiments of FIGS. 7 through 9, the incremental stop mechanism for prepositioning or retaining the spacing S of jaws 11 after actuating and releasing the drive is illustrated and explained. This additional or add on incremental stop mechanism 40 is provided in the face plate 41 of handle body 14. The incremental stop mechanism 40 is comprised in combination of elongate slot 42 in the face plate 41 of handle body 14 and the exposed spring biased depression button 43.

Slot 42 is aligned with drive rod 15 and is provided with rack 44 along one side of the slot. Exposed spring biased depression button 43 is received in slot 42 for sliding therealong and button 43 is provided with an inwardly protruding shaft 45 that extends through slot 42. Shaft 45 is further provided with a radially extending cog 46 for engaging rack 44 when button 43 is not depressed or is disengaged under the spring bias of spring 47.

Button shaft 45 is dimensioned for engaging the drive mechanism of the pliers 10 to incrementally retain the jaws 11 to a desired starting position S after release lever 22 is engaged to release a clamped work piece. Button 43 is pressed to release cog 46 from rack 44 whereby the button 43 together with its shaft 45 may be slid along slot 42 to engage the drive mechanism of the pliers 10 to incrementally retain the spacing of jaws 11 to a desired starting position after an initial use when release lever 22 is engaged.

The button shaft 45 is dimensioned whereby it engages the pivotal coupling pin of pivot 16 adjacent end 17 of drive rod 15 for engaging the drive mechanism to incrementally retain or prevent jaws 11 from fully opening after engagement with a work piece (not shown) and subsequent release. This operational sequence is diagrammatically illustrated in FIGS. 8A through 8F.

The process is initiated in FIGS. 8A and 8B by depressing button 43 under spring bias of spring 47 inwardly or downwardly as indicated by the arrow in FIG. 8B. When the button 43 is in its fully pressed position as illustrated in FIG. 8C, the button 43 is then capable of being slid along slot 42 as cog 46 is no longer engaged with rack 44.

Button 43 in this pressed condition may then be slid upwardly along slot 42 whereby the distal end of shaft 45 will engage the pin of pivot 16, thereby retaining the position of drive rod 15 along with button 43 to preposition the initial starting gap between jaws 11 after release.

Once shaft 45 engages the pin of pivot 16 as represented in FIGS. 8E and 8F (pivot 16 is not represented in this figure), button 43 is released as indicated by the arrow in FIG. 8F whereby cog 46 engages rack 44 (FIG. 8D) and shaft 45, still engaging the pin of pivot 16, prevents drive rod 15 from fully displacing or moving downwardly after the drive mechanism is released by pressing release lever 22.

The next workpiece (not shown) can then be positioned between the prepositioned jaws 11 and the lever 27 again actuated to grip the next work piece between jaws 11. The incremental of stop mechanism eliminates the need to repeatedly acuate lever 27 numerous times in order to get the jaws 11 to an initial desired spacing prior to engaging the next workpiece. This provides fast one handed operation of the pliers 10 with easy and fast initial positioning of the jaws 11.

I claim:

1. A device comprising:

a pair of jaws pivotally coupled to a handle body and a drive for pivotally actuating at least one of said jaws, said drive comprising:

a drive rod received in said handle body for axial movement with one end of said rod pivotally linked to said at least one jaw for pivoting said at least one jaw with axial movement of said rod;

an actuating lever pivotally connected at one end to said handle body and extending therefrom for single hand actuation by squeezing said lever against spring bias toward said handle body, said actuating lever having a leverage arm extending from said one end toward said drive rod;

a drive grip lever having an aperture surrounding said rod for binding against said rod and thereby slidably moving said rod in one direction when said drive grip lever is canted and moved;

a distal end of said leverage arm pivotally coupled to said drive grip lever whereby said drive grip lever will cant and thereby bind said aperture on said rod when said actuating lever is pivoted to thereby axially move said rod in said one direction to correspondingly pivot said at least one jaw;

an incremental stop mechanism for limiting opening movement of said jaws after actuating and releasing said drive, said mechanism comprised of an elongate slot in said handle body, said slot aligned with said drive rod and having a rack along one side edge of said slot, an exposed spring biased depression button received in said slot for sliding therealong and having an inwardly protruding shaft extending through said slot and having a radially extending cog for engaging said rack when said button is disengaged under spring bias, said button shaft dimensioned for engaging said drive mechanism and incrementally retaining said jaws from fully opening when said button is pressed to release said cog from said rack and slide in said slot to engage said drive mechanism to thereby incrementally retain said jaws from fully opening upon release of said drive mechanism.

2. Pliers comprising:

a pair of plier jaws pivotally coupled to one end of an elongate handle body;

a drive rod received in said handle body for axial movement relative to said handle body in the direction of elongation of said handle body;

said jaws pivotally coupled to an adjacent end of said drive rod with respective drive links and configured for closing said jaws when said drive rod is axially moved toward said jaws;

said drive rod engaged with a spring biasing said rod to axially move in a direction away from said jaws for thereby urging said jaws open;

a release lever positioned for pivotal movement in said handle body and having a position-holding grip aperture surrounding said drive rod, said release lever positioned in said handle body under spring bias for said position-holding grip aperture to axially cant relative to the axis of said drive rod for thereby causing said position-holding grip aperture to normally bind and grip on to said drive rod and prevent movement of said drive rod away from said jaws, said release lever configured to release said drive rod when an outer end of said release lever is depressed against its bias;

an actuating lever extending from said handle body and pivotally connected at one end to said handle body and having a leverage arm laterally extending from said one end toward said drive rod with a distal end of said leverage arm spaced from the leverage arm pivot;

a drive grip lever having an aperture surrounding said drive rod and moveable toward said jaws for canted binding engagement with said drive rod to move said drive rod toward said jaws;

said distal end of said leverage arm pivotally coupled to said drive grip lever for canting said drive grip lever and moving said drive rod toward said jaws with said canted drive grip lever when said actuating lever is pivoted toward said handle body to close said jaws; and a spring biasing said drive grip lever to move in a direction away from said jaws for releasing the grip of said drive grip lever on said drive rod and bias said actuating lever outwardly for repeated actuation whereby repeated actuations of said actuating lever closes said jaws with a linear step-by-step action of said drive rod between said drive grip lever and said release lever;

an incremental stop mechanism for limiting opening movement of said jaws after said release lever is actuated to release said drive rod, said mechanism comprised of an elongate slot in said handle body, said slot aligned with said drive rod and having a rack along one side edge of said slot, an exposed spring biased depression button received in said slot for sliding therealong and having an inwardly protruding shaft extending through said slot and having a radially extending cog for engaging said rack when said button is disengaged under spring bias, said button shaft dimensioned for engaging said drive mechanism and incrementally retaining said jaws from fully opening when said button is depressed to release said cog from said rack and slide in said slot to engage said drive mechanism to thereby incrementally retain said jaws from fully opening upon release of said drive mechanism.

3. The pliers of claim 2, wherein said button shaft engages the pivotal coupling of said jaws to said adjacent end of said drive rod for thereby stopping the full movement of said drive rod away from said jaws upon actuation of said realease mechanism.

* * * * *